US011434050B2

(12) United States Patent
Kirchner

(10) Patent No.: US 11,434,050 B2
(45) Date of Patent: Sep. 6, 2022

(54) STOPPER FOR A CONTAINER FOR USE IN FREEZE-DRYING PROCESSES, AND ASSEMBLY OF A STOPPER AND A CONTAINER

(71) Applicant: KISICO KIRCHNER, SIMON & CO. GMBH, Oestrich-Winkel (DE)

(72) Inventor: Jan Kirchner, Oestrich-Winkel (DE)

(73) Assignee: KISICO KIRCHNER, SIMON & CO. GMBH, Oestrich-Winkel (DE)

( * ) Notice: Subject to any disclaimer, the term of this patent is extended or adjusted under 35 U.S.C. 154(b) by 301 days.

(21) Appl. No.: 16/466,466

(22) PCT Filed: Sep. 26, 2017

(86) PCT No.: PCT/EP2017/074314

§ 371 (c)(1),
(2) Date: Jun. 4, 2019

(87) PCT Pub. No.: WO2018/103906

PCT Pub. Date: Jun. 14, 2018

(65) Prior Publication Data

US 2019/0389630 A1 Dec. 26, 2019

(30) Foreign Application Priority Data

Dec. 6, 2016 (EP) ..... 16202437

(51) Int. Cl.
*B65D 39/00* (2006.01)
*B65D 51/00* (2006.01)
(Continued)

(52) U.S. Cl.
CPC ..... *B65D 39/0076* (2013.01); *B65D 39/0094* (2013.01); *B65D 51/002* (2013.01);
(Continued)

(58) Field of Classification Search
CPC ..... B65D 39/0076; B65D 39/0094; B65D 39/00; B65D 2539/003; B65D 2539/005;
(Continued)

(56) References Cited

U.S. PATENT DOCUMENTS 2,820,564 A * 1/1958 Solomon ..... B65D 39/0023 215/231
2,889,951 A * 6/1959 Hennings ..... B65D 39/0029 215/231
(Continued)

FOREIGN PATENT DOCUMENTS

DE 1942347 A1 3/1971
DE 3736343 A1 5/1989
(Continued)

OTHER PUBLICATIONS

European Patent Office, International Search Report of the International Searching Authority (EP/ISA) in International Application No. PCT/EP2017/074314, dated Nov. 10, 2017, 6 pages, EPO, Rijswijk, Netherlands (NL).
(Continued)

*Primary Examiner* — James N Smalley
*Assistant Examiner* — Jennifer Castriotta
(74) *Attorney, Agent, or Firm* — Christopher C. Dremann, P.C.; Christopher C. Dremann

(57) ABSTRACT

A stopper for a container and an assembly of a stopper and a container wherein the stopper has an insertion section configured for insertion into the container. The insertion section has a sealing section for closing the container in a sealing position of the stopper and a contact section for holding the stopper in a drying position of the stopper. The contact section has at least one passage opening for a gas exchange between an interior of the container and the surroundings of the container. The stopper has a sealing body and a main body connected together, wherein the main body has a higher degree of hardness than the sealing body. Regions of a lateral surface of the insertion section in contact with an inner surface of a container wall are formed by outer surfaces of the sealing body in the region of the contact section.

14 Claims, 8 Drawing Sheets

(51) Int. Cl.
*B65D 51/24* (2006.01)
*F26B 5/06* (2006.01)

(52) U.S. Cl.
CPC ..... *B65D 51/241* (2013.01); *B65D 2539/008* (2013.01); *F26B 5/06* (2013.01)

(58) Field of Classification Search
CPC ..... B65D 2539/006; B65D 2539/008; B65D 51/241; F26B 5/06
See application file for complete search history.

(56) References Cited

U.S. PATENT DOCUMENTS 2,927,709 A * 3/1960 Hoffman ..... B65D 51/241 215/355
3,292,342 A * 12/1966 Kapeker ..... F26B 5/06 53/101
4,040,421 A * 8/1977 Young ..... A61M 5/343 604/192
4,306,357 A 12/1981 Villarejos
5,377,854 A * 1/1995 Cusack ..... B65D 51/241 215/307
5,487,737 A * 1/1996 Meyer ..... A61J 1/2089 604/403
5,596,814 A 1/1997 Zingle et al.
5,689,895 A 11/1997 Sutherland et al.
9,199,768 B1 12/2015 Casey

FOREIGN PATENT DOCUMENTS

DE 202011050413 U1 10/2012
EP 1004287 A1 5/2000
EP 3384219 B1 11/2020
FR 1479255 A 5/1967

OTHER PUBLICATIONS

European Patent Office, Written Opinion of the International Searching Authority (EP/ISA) in International Application No. PCT/EP2017/074314, dated Nov. 10, 2017, 6 pages, EPO, Rijswijk, Netherlands (NL).

* cited by examiner

STOPPER FOR A CONTAINER FOR USE IN FREEZE-DRYING PROCESSES, AND ASSEMBLY OF A STOPPER AND A CONTAINER

CROSS-REFERENCE TO RELATED APPLICATIONS

This application is the United States national stage of International Application No. PCT/EP2017/074314 filed on Sep. 26, 2017, which claims priority to European Application No. 16202437.6 filed on Dec. 6, 2016, the entire disclosure being incorporated herein by reference.

FIELD OF THE INVENTION

The invention relates to a stopper for a container for use in freeze-drying processes, also referred to as lyophilization. The invention further relates to an assembly of a stopper and a container for use of the assembly during freeze-drying processes.

BACKGROUND OF THE INVENTION AND RELATED ART

In a method for producing a freeze-dried product, as is frequently used in the field of medical diagnostics, chemical analysis, the food industry and/or pharmaceutical industry, in order to produce, for example, diagnostic products and/or medicaments, initially a solution with corresponding constituents is produced and this solution is subsequently dried in a freeze-drying system. The solvent used for producing the solution is typically water and the solution is accordingly an aqueous solution. In principle, other solvents or mixtures thereof may also be used with aqueous systems, for example an alcohol, in particular ethanol, or an organic solvent. Generally, the solution is initially filled into a container, for example a glass cuvette or glass bottle, for the purpose of freeze-drying. In order to prevent a contamination of the solution and/or the container interior during the process of freeze-drying and/or subsequent to the freeze-drying process, generally a stopper is inserted into the container in order to close this container partially or, subsequent to the freeze-drying process, fully for the purpose of freeze-drying.

The stopper is designed in this case such that during the freeze-drying process a gas exchange is possible between the interior of the container and the surroundings. This may be achieved, for example, by the stopper being only partially inserted into the container in a drying position during the process of freeze-drying and thus the container not yet being sealingly closed. In this manner, during the freeze-drying process the solvent, in particular water, is removed from the solution in order to dry the constituents of the solution. Subsequent to the freeze-drying process the stopper is typically pushed further into the container by means of a device which is configured in the freeze-drying system, so that the stopper is in the sealing position in which the stopper closes the container in a fluid-tight manner. The term "fluid" is hereinafter used as a common term for gases and for liquids. The term "fluid-tight" is accordingly understood such that in the sealing position a penetration of gases and/or liquids, in particular water vapor or oxygen, into the interior of the container and an escape of substances from the interior of the container is prevented. Subsequently thereto, a safety closure is frequently attached to the container in order to secure the stopper. This safety closure may be, for example, a flanged cap or a screw closure. Such stoppers are generally configured in one piece.

A one-piece stopper for use in a freeze-drying method is disclosed, for example, in the publication DE 20 2011 050 413 U1. The piston stopper has an upper face and a lower face, wherein the lower face opposes the upper face in an axial direction. The piston stopper in the region of the lower face has at least one continuous, outwardly open recess for the gas exchange during the freeze-drying process, said opening being open downwardly in an axial direction and in a radial direction.

A cap arrangement for a receptacle for freeze-drying is disclosed in U.S. Pat. No. 4,306,357 A, wherein the cap arrangement has a one-piece closure stopper for insertion into an opening of a receptacle for freeze-drying, wherein the stopper is configured with ribs on the shank thereof so that in a drying position of the stopper when a cap flange is located spaced apart from a receptacle flange, the ribs form ventilation channels with an inner surface of the flange of the receptacle in order to permit a fluidic communication with regard to the freeze-drying, in particular a gas exchange between the interior of the receptacle and the outer face.

A further stopper for use during freeze-drying is disclosed in U.S. Pat. No. 5,596,814 A.

A device for positioning a measuring probe in a container for use during freeze-drying is disclosed in U.S. Pat. No. 5,689,895 A. The measuring probe serves for measuring the physical parameters, such as for example the temperature, during freeze-drying. The device comprises a one-piece stopper, wherein a guide tube, which penetrates the stopper, is arranged in a central opening of the stopper, wherein this guide tube extends into the container interior when the stopper is inserted into a container opening. The guide tube serves for receiving the measuring probe in order to arrange this measuring probe centrally and at a specific height in the container interior. The stopper further comprises at least one further opening which penetrates the stopper and which permits a gas exchange when the stopper is inserted into the container between the container interior and the container surroundings. The at least one further opening is preferably designed such that when the stopper is inserted into the container the gas exchange is similar or identical to the gas exchange of a conventional freeze-drying stopper in a drying position of the freeze-drying stopper. Due to the application and the design of the stopper of the device for positioning a measuring probe, however, the device or the stopper of the device is not provided and is also not suitable for closing the container in a fluid-tight manner subsequent to the freeze-drying process.

The stoppers used currently in the field of freeze-drying, also denoted as lyophilization stoppers or freeze-drying stoppers, are generally produced from a butyl rubber, for example bromobutyl rubber or chlorobutyl rubber. The production of the stopper as a rubber molded part is relatively cost-intensive since firstly the material costs are relatively high and additionally the rubber mixture has to be fully cured in a heated mold, whereby the cycle times and the energy required during production are relatively high.

A stopper is disclosed in FR 1 479 255 A which comprises an element or a central core made of a rigid material which is opaque, transparent or translucent, such as for example glass, wherein this element and/or the central core comprises a head and an axial body. The stopper also has a sleeve-shaped element made of plastics, wherein the sleeve-shaped element encloses the axial body. The sleeve-shaped plastics element has on its peripheral surface at least one bead or a sealing rib for contact with the inner surface of a container neck of the container to be closed. The bead and/or the sealing rib is designed such that it may freely deform during the closing process.

Freeze-drying stoppers which are configured in two parts are also known, wherein the two parts of the stopper are produced from different materials. Such a stopper is disclosed in the publication DE 1 942 347 A. The stopper has an insertion section which can be inserted into the container, wherein the insertion section has a lateral surface and a bottom surface, wherein the bottom surface is configured opposite a top surface of the stopper in an axial direction of the stopper. The insertion section in turn has a sealing section for closing the container in a fluid-tight manner from the surroundings of the container in a sealing position of the stopper and a contact section which adjoins the sealing section axially from the top surface in the direction of the bottom surface, for holding the stopper in a drying position of the stopper during the freeze-drying process, wherein the contact section has at least one passage opening for a gas exchange between an interior of the container and the surroundings of the container during the freeze-drying process, wherein this passage opening extends from the lateral surface into the bottom surface. The stopper further has a sealing body and a main body which are connected together.

In the case of the stopper according to the aforementioned publication, the sealing body is formed by an upper part of the stopper and the main body is formed by a lower part of the stopper, wherein outer surfaces of the sealing body in the region of the sealing section form the lateral surface of the insertion section and the main body is configured within the sealing body in the region of the sealing section. The contact section, however, is formed by the main body. Accordingly, the lateral surface of the insertion section is formed in the region of the contact section and the bottom surface of the insertion section is formed by the outer surfaces of the main body. In order to ensure a secure positioning and retention of the stopper at the predetermined height before and during the freeze-drying process, it is provided that the main body consists of a material which has a higher degree of hardness than a material which makes up the sealing body. In order to hold the stopper securely in the drying position relative to the insertion depth, locking lugs of the main body bear directly against a container wall of the container.

An assembly of a stopper and a container for use of the assembly during freeze-drying is also disclosed in DE 1 942 347 A.

OBJECTS AND SUMMARY OF THE INVENTION

It is an object of the present invention to develop a stopper such that with lower material costs and a lower production cost the stopper nonetheless has a particularly good sealing property and/or blocking property and/or chemical resistance and additionally has a stiffness which is sufficient for simple and safe handling, while damage to the stopper or container during insertion of the stopper into, or during removal of the stopper from, the container is nonetheless avoided. Moreover, it is an object of the invention to develop an assembly which has the aforementioned advantages. In particular, the stopper is designed such that a use of butyl rubber and thus fully curing the stopper may be dispensed with.

For achieving the aforementioned objects, the invention proposes a stopper which is configured according to the features disclosed herein. Moreover, the invention proposes an assembly of a container and a stopper which has the features disclosed herein.

The stopper according to the invention is designed such that regions of the lateral surface of the insertion section, which are in contact with an inner surface of a container wall of the container in the drying position and/or the sealing position, are formed by outer surfaces of the sealing body in the region of the contact section, wherein the main body is configured within the sealing body in the region of the contact section. Accordingly, in the region of the insertion section only outer surfaces of the more flexible sealing body come into contact with the inner surface of the container wall.

By this design of the stopper, a wall thickness of the sealing body and the main body is reduced relative to the total expansion of the stopper. In particular, the reduction of the wall thickness of the sealing body by forming the main body within the sealing body leads to a reduction in the material required for the sealing body, whereby the production costs are reduced since a material may be used for the main body which is more cost-effective relative to the material of the sealing body.

In such a configuration of the stopper the sealing body may be produced from a more flexible material which respectively has the desired material properties, for example the required elasticity or sealing action. Accordingly, the main body, which due to the design of the insertion section in the region of the insertion section does not come into contact with the container wall, may be produced from a harder, more cost-effective material, for example polypropylene (PP). By the main body being arranged in the sealing body, the stopper is reinforced in the interior in the region of the sealing section, whereby in spite of reducing the wall thickness of the sealing body relative to a stopper which in the region of the sealing section consists of a solid material, the sealing action of the stopper is approximately the same or even increased. Since the main body is configured within the sealing body in the region of the contact section, the contact section also has the required stiffness for the secure retention of the stopper in the drying position. Due to the fact that only the more flexible sealing body and not the harder main body comes into direct contact with the container wall, the insertion of the insertion section into the container is facilitated and a secure retention is nonetheless ensured. Damage, for example a rupture or material wear of the main body or the container, in particular in the case of a thin-walled glass container, as might arise with direct contact between the hard main body and container, in particular when inserting the stopper into, or pulling the stopper out from, the container, is also avoided. Even slight material wear of the stopper or the container, which enters the interior of the container, may lead to a contamination of the substance stored in the container, which makes the substance unusable for the designated use.

Additionally, due to the reduced wall thickness of the sealing body and the stiffness due to the harder main body, the formation of a bead in the sealing body may be avoided when inserting the insertion section.

Moreover, the configuration of the stopper with a main body which is configured from a harder material within the sealing body, may also be regarded as advantageous with regard to a production method of the stopper. With a corresponding selection of the material of the sealing body and the main body, the stopper may be produced by means of a multi-component injection-molding method, in particular by means of a two-component injection-molding method, wherein the stopper is stiffened by the main body which is harder relative to the sealing body, whereby removing of the stopper from an injection-molding tool is facilitated. In this case, it is conceivable that when removing from an injection-molding tool an ejector does not push at least exclusively into the more flexible material of the sealing body but also pushes into the harder material of the main body or even exclusively acts on the main body, whereby the removing is facilitated and damage to the stopper during the process of removing is avoided.

Moreover, when inserting the stopper into an opening of the container or pulling out the stopper from the opening, the safe handling of the stopper is facilitated, since with the action of a force on the stopper for the purpose of inserting the stopper, too great a deformation of the stopper, in particular in the region of the sealing section, is avoided due to the stiffening of the stopper by the harder main body. Such a deformation may lead, for example, to the sealing section not closing the container in a fluid-tight manner in the sealing position of the stopper, or the deformation being so great that it leads to damage to the stopper or the container.

In particular with regard to simple production and effective sealing action, in an advantageous embodiment outer surfaces of the sealing body form the lateral surface of the insertion section in the region of the contact section.

However, it is also perfectly conceivable that partial regions of the lateral surface of the insertion section are formed by the outer surfaces of the main body in the region of the contact section. In such an embodiment, the requirement of material for the sealing body is reduced relative to the requirement of material in an embodiment in which outer surfaces of the sealing body form the lateral surface of the insertion section in the region of the contact section. This embodiment is based on the surprising recognition that for many solvents, in particular water, and/or substances stored in the container, a direct contact between these solvents and/or these substances and the main body only slightly affects the sealing action of the stopper or does not affect it at all and also any contamination of the container interior with the material of the main body is avoided if it is ensured that regions of the lateral surface of the insertion section, which are in contact with an inner surface of a container wall of the container in the drying position and/or the sealing position, are formed by outer surfaces of the sealing body in the region of the insertion section. The same also applies to an embodiment in which the bottom surface or partial regions of the bottom surface of the insertion section is or are formed by an outer surface or outer surfaces of the main body. In this case it is regarded as expedient if the material of the main body is resistant to the solvent used and/or the solvents used and the substances stored in the container.

In order to achieve a particularly effective stiffening of the contact section and the sealing section, the main body is preferably configured as a solid body. With regard to a particularly simple production, the main body is preferably substantially circular cylindrical at least in the region of the insertion section.

In one embodiment of the stopper it is provided that the main body has an outer surface, wherein at least a partial region of this outer surface is not covered by the sealing body in the axial direction of the stopper. In such an embodiment, the main body is accessible mechanically from outside in the axial direction so that a force may be directly applied onto the main body without having a direct effect on the sealing body. Thus, for example, for the purpose of removing the stopper, an ejector of an injection-molding tool may push directly onto the main body.

Preferably, in such an embodiment the main body protrudes in the axial direction relative to the sealing body or the corresponding outer surface of the sealing body terminates in a planar manner with this outer surface of the main body. As a result, it is avoided that forces acting in this direction from the outside act directly on the sealing body. However, it is also perfectly conceivable that the sealing body protrudes in the axial direction relative to the main body.

It is regarded as advantageous if the outer surface of the main body forms at least a partial region of the bottom surface and/or the top surface. Preferably, the bottom surface and/or the top surface is exclusively formed by the main body.

If the sealing body covers the main body in the axial direction, it is regarded as particularly advantageous if the covering region of the sealing body has a relatively small axial dimension. Preferably, a ratio of this axial dimension relative to a radial dimension of the sealing section, in particular the diameter of the sealing section, is between about 0.02 and about 0.10, in particular between about 0.02 and about 0.06.

In another embodiment of the stopper it is provided that the outer surfaces of the sealing body form the lateral surface and the bottom surface of the insertion section. With such a configuration of the stopper, the sealing body which comes into contact with the container and the contents of the container may be produced from a material which in each case has the desired material properties, for example the required elasticity, chemical resistance and/or blocking property relative to the substance stored in the container or the substances stored in the container and/or the solvent of the solution used. However, the main body may be produced from a different material. Thus, for example, a material may be selected for the sealing body which has a good blocking action and/or chemical resistance to the substances stored in the container interior or comprises the solvent used, and a material may be selected for the main body which is generally more cost-effective and which has a less effective blocking action and/or chemical resistance to these substances or the solvent used, since these substances and/or the solvent do not come directly into contact with the main body.

In an exemplary embodiment, the sealing body is configured to be pot-shaped or substantially pot-shaped. In particular, the sealing body in the region of the insertion section is configured as a hollow cylinder or substantially as a hollow cylinder, preferably with a closed bottom surface.

Moreover, by a suitable selection of the material combination of the material of the sealing body and the material of the main body, the blocking action of the stopper may be adapted in a simple manner to the substances to be stored in the container and/or the solvent used and/or the surrounding atmosphere. Thus, for example, a material may be selected for the sealing body which has an effective blocking action and/or chemical resistance to the substances stored in the container interior, for example an organic solvent, and a material may be selected for the main body which has an effective blocking action and/or chemical resistance to substances which are present in the surroundings of the container, for example oxygen or water. As a result, by a corresponding selection of the material, a contamination of the contents of the container by substances from the surroundings, for example oxygen, may be avoided or at least reduced.

Preferably, the sealing body and the main body are directly connected together. Thus in this embodiment it is not necessary to bond together the sealing body and the main body by means of an additional adhesive. In particular, the sealing body and the main body are directly connected together by a material connection. By this direct connection, in particular direct material connection, between the sealing body and the main body, the sealing body and the main body are connected unreleasably together, whereby the stopper is approximately in one piece. By the approximately one-piece configuration of the stopper, the use of the stopper, in particular with regard to an automated freeze-drying method in which the mechanical insertion of the stopper is automated, is facilitated. By the approximately one-piece configuration, when the stopper is subjected to mechanical load, for example for the purpose of opening or closing the container, the sealing body is prevented from being released from the main body, and during the process of opening the container, for example, the sealing body is prevented from remaining in the container, or when inserting the stopper a bead is prevented from being formed on the sealing body by a relative movement of the sealing body to the main body, which has a negative effect on the sealing action of the stopper.

It is also conceivable to weld the sealing body to the main body.

Preferably, the material connection is implemented without an additional method step, by the sealing body being injection-molded onto the main body or the main body being injection-molded onto the sealing body by means of an injection-molding method.

In one embodiment, a cross section of the stopper with a circular outer contour is formed in the region of the sealing section perpendicular to the axial direction of the stopper. In a container with a correspondingly designed circular opening, in the sealing position the sealing section in this region comes to bear against the inner surface of the container wall defining the opening in a peripheral manner and seals the container.

In particular, with regard to a reduction in the material of the sealing body but nonetheless with an effective sealing property of the stopper, it is regarded as particularly advantageous if the sealing body in the region of the sealing section has a circular cross section perpendicular to the axial direction of the stopper. Preferably, a ratio from an external radius of the annulus relative to an internal radius of the annulus is from about 1.1 to about 2.5.

In order to improve the blocking action of the stopper relative to the substances to be stored in the container and/or the atmosphere located outside the container, in a preferred embodiment of the stopper it is provided that the stopper has a blocking body or a blocking layer. By means of the blocking body and/or the blocking layer, for example, a diffusion of oxygen into the interior of the container may be prevented or at least reduced by the stopper. The material of the blocking body and/or the blocking layer may, for example, be a plastic, for example vinyl alcohol copolymer (EVOH), or aluminum, in particular an aluminum film.

It is perfectly conceivable that the blocking layer and/or the blocking body forms the top surface. Preferably, however, the blocking body and/or the blocking layer is configured between the main body and the sealing body. As a result, the blocking layer and/or the blocking body is particularly effectively protected against damage by externally acting forces.

In this connection, it is regarded as particularly advantageous if the blocking body and/or the blocking layer is connected by a material connection to the main body and/or by a material connection to the sealing body.

In an exemplary embodiment of the stopper, an outer surface of the main body forms the top surface of the stopper, wherein the top surface covers the sealing body in the axial direction. As a result, firstly the handling of the stopper is facilitated by the top surface which is harder relative to the sealing body and secondly the effective outer surface of the stopper is reduced since the surface of the sealing body which comes into contact with the surrounding air is reduced by the cover, by means of the top surface of the main body, whereby with a suitable selection of the material of the main body in combination with the selection of the material of the sealing body, a diffusion of substances from the surroundings into the container and/or a diffusion of substances from the container into the surroundings may be at least reduced.

It is regarded as particularly advantageous if the stopper has a cover section adjoining the insertion section in the axial direction, in particular the cover section comprises the top surface, and wherein a radial dimension of the cover section is at least as large as, and preferably is larger than, the radial dimension of the insertion section.

In particular, the embodiment of the cover section with a larger radial dimension may be regarded as advantageous in that the insertion depth of the stopper into the container is limited by the cover section in the sealing position of the stopper. When inserting the stopper with a larger cover section relative to the insertion section, the region of the cover section protruding relative to the insertion section in the sealing position of the stopper comes to bear against an outer surface of the container wall of the container facing the cover section, whereby the further insertion of the stopper into the container is prevented.

Moreover, a removal of the stopper from the container is facilitated by a cover section with a larger radial dimension since an easily accessible action surface on the stopper is formed by the cover section.

The cover section may be configured as a peripheral flange.

It is regarded as advantageous if an outer surface of the sealing body forms a bearing surface of the cover section remote from the top surface. When inserting the stopper into the container this bearing surface comes into contact with the outer surface of the container, whereby this bearing surface contributes to the sealing action of the stopper.

In an exemplary embodiment of the stopper, the main body in the region of the cover section has a first projection configured in the radial direction, wherein the first projection is configured, in particular, as a peripheral first projection. This projection may serve for holding the stopper in an additional closure which may be attached to the container. This closure, for example, may be a flanged cap or a screw closure. Typically, such an additional closure is attached to the container subsequent to the freeze-drying method, in order to secure the stopper. In this case, it is perfectly conceivable that the stopper is fully inserted into the container by attaching the closure to the container.

The stopper may be held in the closure, for example, by a partial region of the closure engaging behind the first projection on the side facing the container, for example the first projection is arranged in an undercut of the closure. By means of the connection between the closure and the stopper it is ensured that when removing the closure from the container, for example when unscrewing a closure configured as a rotary closure, the stopper is pulled out of the container.

With regard to the connection between the stopper and the closure it is perfectly conceivable that the closure is already connected to the stopper before the process of freeze-drying.

In order to reduce further the effective outer surface of the stopper, in an advantageous embodiment of the stopper, the main body covers at least partially the sealing body in the region of the cover section radially outwardly. To this end, in an exemplary embodiment, the main body in the region of the cover section has a radially outwardly configured second projection extending from the top surface in the direction of the bottom surface, wherein the second projection at least partially covers the sealing body in the region of the cover section radially outwardly. Preferably, the sealing body is radially enclosed by the second projection.

In an advantageous embodiment of the stopper, a partial region of the sealing body extending from the bottom surface in the direction of the top surface is radially enclosed by the main body. As a result, the contact surface between the sealing body and the main body is increased, which has an advantageous effect on the stability of the connection therebetween.

It is regarded as particularly advantageous if the main body has a through-channel extending from the top surface in the direction of the bottom surface. This through-channel, for example, permits the contents to be removed from the container, by means of a syringe or the like, without having to remove the stopper from the container. To this end, a needle or the like may be inserted into the through-channel, wherein the bottom surface of the sealing body is penetrated in the region adjoining the through-channel and thus the contents of the container are accessible.

It is perfectly conceivable and preferred that a partial region of the sealing body extending from the bottom surface in the direction of the top surface is configured in the through-channel.

The configuration of the main body with a through-channel may also be regarded as advantageous in terms of production of the stopper by means of injection-molding. For example, initially a main body with a through-channel may be injection-molded and subsequently thereto the sealing body may be injection-molded from the side facing the top surface, through the through-channel onto the main body. As a result, the required tool technology is considerably simplified and the tool is more cost-effective, more robust and has a longer service life. In this case, it is regarded as particularly advantageous if the through-channel is configured centrally in the main body, whereby shape tolerances, in particular with regard to the round shape of the main body, may be reduced.

It is regarded as particularly advantageous if the insertion section, in particular the sealing body, has at least one recess, wherein the at least one recess forms the at least one passage opening for the gas exchange. Such a recess is open in the direction of the bottom surface in the axial direction and is open in the radial direction. In this case, it is perfectly conceivable that an outer surface of the insertion section defining the recess is at least partially formed by the main body.

Since such a stopper with a recess does not bear in a peripheral manner against the inner surface of the container wall in the drying position, but only a partial region of the inner surface adjoining the contact section is in contact with the sealing body, it is regarded as expedient with regard to a secure retention of the stopper in the drying position if a proportion of this partial region on the region of the inner surface of the container which adjoins the contact section is at least about 20%, in particular at least about 40%, in the drying position.

Preferably, the sealing body consists of a material which has a Shore A hardness of about 40 to about 80, preferably a Shore A hardness of about 50 to about 70, according to DIN ISO 7619-1: 2010 and/or the sealing body consists of a thermoplastic elastomer (TPE).

With regard to the main body it is regarded as particularly advantageous if the main body consists of a material which has a Shore D hardness of about 30 to about 100, preferably a Shore D hardness of about 40 to about 85, according to DIN ISO 7619-1: 2010 and/or the main body consists of polypropylene (PP) or high density polyethylene (HDPE).

Preferably, the contact section is free of regions protruding outwardly relative to the sealing section in the radial direction. Accordingly, the contact section has no regions which protrude relative to the sealing section, such as locking lugs, beads or the like, which in the drying position bear against the container wall in the axial direction in order to hold the stopper in the drying position at a specific insertion depth. In such an embodiment, the stopper is only held by the contact section being in contact with the inner surface of the container wall. Due to the more flexible material of the sealing body relative to the main body, which forms the regions of the lateral surface of the insertion section which are in contact with the inner surface of the container wall in the drying position and/or the sealing position, and the harder main body, which is arranged within the sealing body and as a result stiffens the contact section, a secure retention in the drying position is possible even without the use of locking lugs or the like. In contrast to a stopper with locking lugs or the like, the transfer of a stopper thus designed from the drying position into the sealing position may take place with a low expenditure of force, since no protruding partial regions have to be deformed. Stoppers with locking lugs, beads or the like also have the drawback that due to the high level of deformation in the region of the locking lugs or beads when transferring the stopper into the sealing position of the stopper, these protruding regions or the container itself are damaged. The removal of the stopper is also made more difficult by locking lugs or the like since in this case the locking lugs or beads are deformed in a direction opposing the deformation during insertion. By loading in the opposing direction, in turn the risk of damage arises or even of the locking lugs or beads being sheared off.

In an advantageous embodiment of the stopper, the main body and/or the sealing body and/or the stopper is symmetrical, in particular radially symmetrical, relative to an axis of symmetry and/or plane of symmetry extending in the axial direction.

Preferably, the stopper is a stopper produced by means of a multi-component injection-molding method, preferably by means of a two-component or a three-component injection-molding method.

In the assembly according to the invention of a container and a stopper for use of the assembly during freeze-drying processes, it is provided that the stopper is inserted into an opening of the container. The stopper has an insertion section inserted into the container, wherein the insertion section has a lateral surface and a bottom surface, wherein the bottom surface is configured opposite a top surface of the stopper in an axial direction of the stopper. The insertion section in turn has a sealing section for closing the container in a fluid-tight manner from the surroundings of the container in a sealing position of the stopper and a contact section which adjoins the sealing section axially from the top surface in the direction of the bottom surface for holding the stopper in a drying position of the stopper during the freeze-drying process, wherein the contact section has at least one passage opening for a gas exchange between an interior of the container and the surroundings of the container during the freeze-drying process, wherein this passage opening extends from the lateral surface into the bottom surface. Moreover, the stopper has a sealing body and a main body which are connected together. The main body consists of a material which has a higher degree of hardness than a material which makes up the sealing body. The main body is configured within the sealing body in the region of the sealing section. Outer surfaces of the sealing body form the lateral surface of the insertion section in the region of the sealing section.

In the drying position of the stopper, the sealing section is arranged outside the container and the contact section is in contact with an inner surface of a container wall of the container, wherein the at least one passage opening opens into the interior of the container and into the surroundings, whereby during the process of freeze-drying a gas exchange is possible between the interior of the container and the surroundings.

In the sealing position of the stopper, relative to the drying position the stopper is inserted further into the container and the sealing section is arranged within the container, wherein the sealing section is in contact in a peripheral manner with the inner surface of the container wall of the container, whereby the sealing section closes the container in a fluid-tight manner.

Regions of the lateral surface of the insertion section, which are in contact with the inner surface of the container wall of the container in the drying position and/or sealing position, are formed by outer surfaces of the sealing body and the main body is configured within the sealing body in the region of the contact section.

Due to the fact that only the more flexible sealing body and not the harder main body is in direct contact with the container wall, the insertion of the insertion section into the container is facilitated and a secure retention is nonetheless ensured. Moreover damage, for example a rupture or material wear, of the main body or the container, in particular in the case of a thin-walled glass container, as could arise in the case of direct contact between the hard main body and the container, is avoided. Even slight material wear of the stopper or the container which may enter the interior of the container may lead to contamination of the substance stored in the container, which makes the substance unusable for the designated use.

The stopper of the assembly may also be configured according to the embodiments described relative to the stopper per se. In particular, the stopper of the assembly is configured according to the features disclosed herein.

It is regarded as particularly advantageous if, in the sealing position of the stopper, the lateral surface of the sealing section bears in a planar manner against the inner surface of the container wall.

Further features of the invention are shown and described hereafter in the description of the figures and the figures themselves, as well as the detailed description of exemplary embodiments.

BRIEF DESCRIPTION OF THE DRAWING FIGURES

The invention is shown with reference to exemplary embodiments in the accompanying drawing figures, without being limited thereto.

DETAILED DESCRIPTION OF EXEMPLARY EMBODIMENTS OF THE INVENTION

Figure 1:
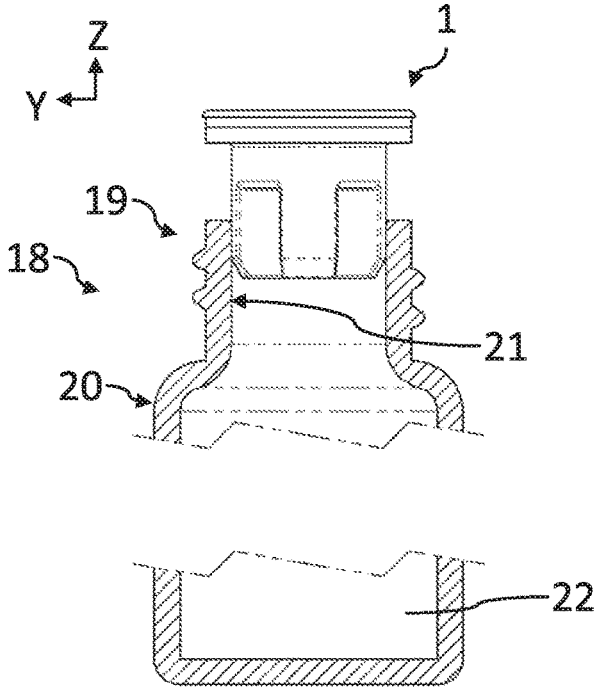
FIG. 1 shows a first embodiment of a stopper and a container in an assembly in which the stopper is partially inserted into the container, in a side view.
Figure 2:
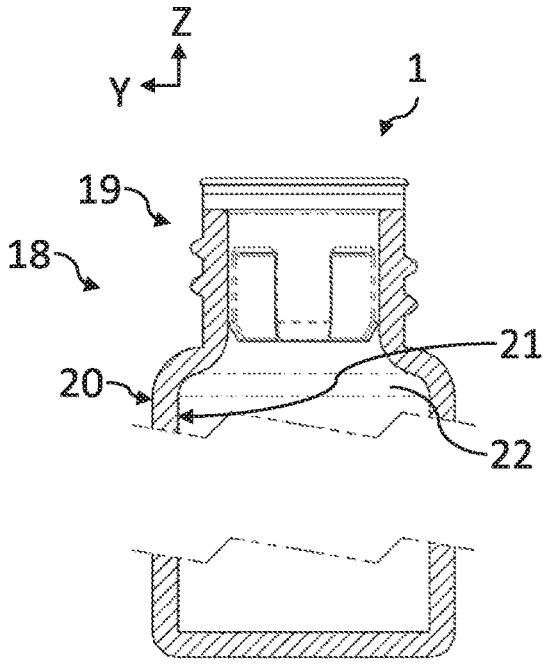
FIG. 2 shows the stopper and the container according to FIG. 1 in an assembly in which the stopper is inserted to a maximum extent into the container, in a side view.
Figure 3:
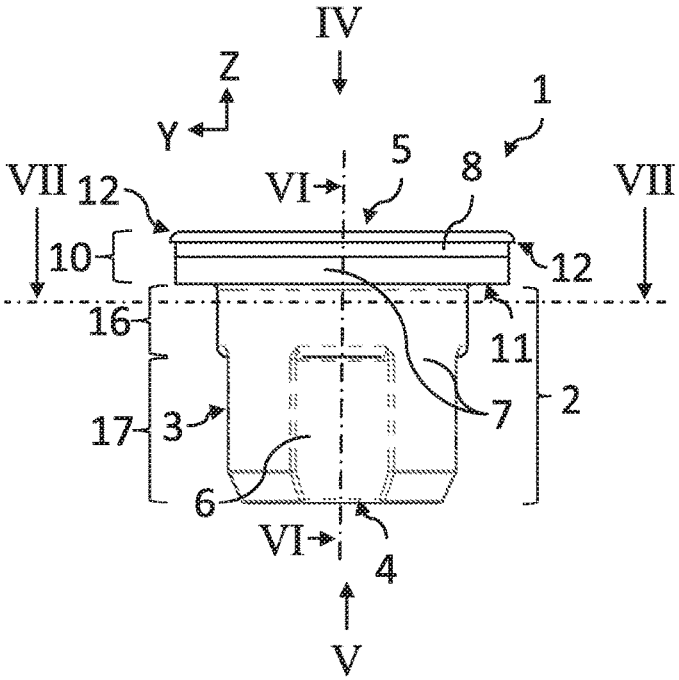
FIG. 3 shows the stopper according to FIG. 1 in a view according to the arrow III in FIG. 6.
Figure 4:
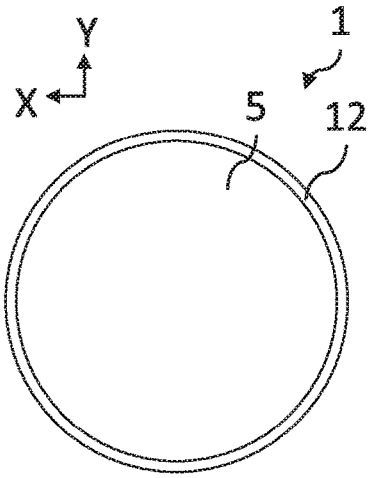
FIG. 4 shows the stopper in a view according to the arrow IV in FIG. 3.
Figure 5:
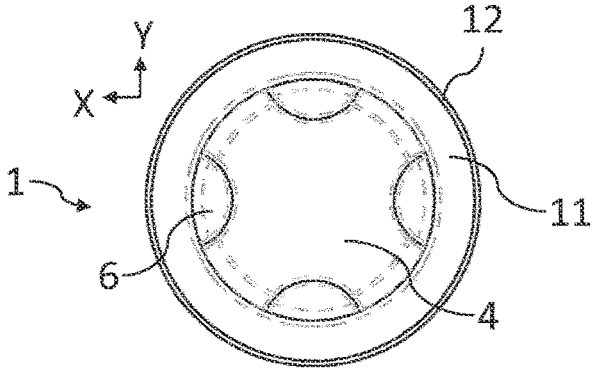
FIG. 5 shows the stopper in a view according to the arrow V in FIG. 3.

FIGS. 1 and 2 illustrate the upper end of a container 18 and a first embodiment of a stopper 1 for use in a freeze-drying method, wherein the stopper is inserted into an opening 23 of the container 18, which is configured in the region of a container neck 19.

In FIGS. 1 and 2, the container 18 is shown in each case in section and the stopper 1 in each case not in section.

In FIG. 1 an assembly of the container 18 and the stopper 1 is shown in which an insertion section 2 of the stopper 1 is partially inserted into the neck 19 of the container 18. This position of the stopper 1 corresponds to a drying position of the stopper 1.

FIG. 2 shows an assembly of the container 18 and of the stopper 1 in which the insertion section 2 of the stopper 1 is fully inserted into the container neck 19 of the container 18 and in an axial direction Z of the stopper 1 a cover section 10 of the stopper 1 adjoining the insertion section 2 bears against an outer surface 20 of the container neck 19. This position of the stopper 1 corresponds to a sealing position of the stopper 1.

The insertion section 2 has a lateral surface 3 and a bottom surface 4, wherein the bottom surface 4 is configured opposite a top surface 5 of the stopper 1 which is configured in the region of the cover section 10 in the axial direction Z of the stopper 1.

The insertion section 2 has a sealing section 16 for closing the container 18 in a fluid-tight manner relative to the surroundings of the container 18 in the sealing position of the stopper 1 and a contact section 17 adjoining the sealing section 16 axially from the top surface 5 in the direction of the bottom surface 4 for holding the stopper 1 in the drying position of the stopper 1 during the freeze-drying process, wherein the contact section 17 has four passage openings 6, wherein the passage openings 6 are configured identically and in each case in the form of a recess 6. The respective recess 6 extends from the lateral surface 3 into the bottom surface 4 and in the drying position of the stopper, thus in a state in which the insertion section 2 of the stopper 1 is only partially inserted into the container 18, permits a gas exchange between an interior 22 of the container 18 and the surroundings. This state is shown in FIG. 1, wherein the contact section 17 of the stopper 1 is partially configured outside the container neck 19, wherein the partial region of the contact section 17 which is located outside the container 18 has a partial region of the respective passage opening 6 which is open in a radial direction X, Y, and in this manner a gas exchange is permitted between the container interior 22 and the surroundings. As a result, in the drying position of the stopper 1 shown in FIG. 1, a solution stored in the container 18 is able to be freeze-dried.

In the drying position of the stopper 1 only a partial region of the inner surface 21 adjoining the contact section 17 is in contact with the sealing body 7. In the present case, the tangential expansion of the respective recess is approximately 45°. As a result, the proportion of the partial region in contact with the region of the inner surface of the container, which adjoins the contact section, is approximately 50%.

The insertion section 2 has a substantially circular cylindrical external contour, wherein the contact section 17 is free of regions which protrude relative to the sealing section 16 in the radial direction X, Y.

In the state shown in FIG. 1, the partial regions of the lateral surface 3 of the contact section 17 bear against an inner surface 21 of the container neck 19, whereby the stopper 1 is held in its partially inserted position, and for further insertion of the stopper 1 an action of force is required on the stopper 1 in the axial direction Z, in the direction of the container 18.

The stopper 1 has a sealing section 16 adjoining the contact section 17 in the direction of the top surface 5, wherein in a state in which the insertion section 2 is fully inserted into the container 18, the sealing section 16 bears in a peripheral manner against the inner surface 21 of the container neck 19, and thus sealingly closes the container 18.

Figure 6:
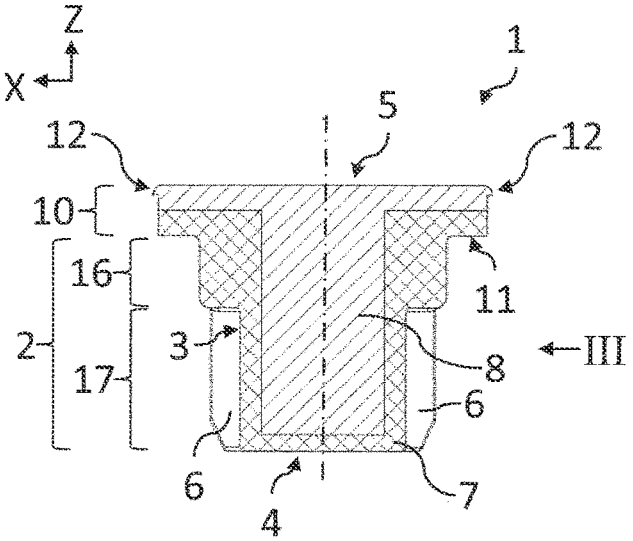
FIG. 6 shows the stopper in a sectional view according to the line VI-VI in FIG. 3.
Figure 7:
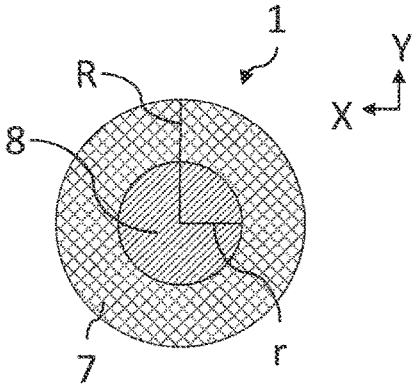
FIG. 7 shows the stopper in a sectional view according to the line VII-VII in FIG. 3.

As may be derived, in particular, from the sectional view of FIG. 6, the stopper 1 has a sealing body 7 and a main body 8, wherein the outer surfaces of the sealing body 7 in the region of the sealing section 16 and the contact section 17 form the lateral surface 3 of the insertion section 2 and the bottom surface 4 of the insertion section 2.

In the present case, the sealing body 8 is configured to be substantially pot-shaped.

The main body 8 is configured in the region of the insertion section 2 within the sealing body 7, whereby only the sealing body 7 comes into contact with the inner surface 21 of the container 18 and the interior of the container 18. The sealing body 7 and the main body 8 are connected together by a material connection. Due to the material connection, the sealing body 7 and the main body 8 are unreleasably connected together so that the stopper 1 is configured approximately in one piece. Preferably, the material connection is produced by a multi-component injection-molding method, in particular a two-component injection-molding method.

The main body 8 and the sealing body 7 consist of different materials, wherein the main body 8 consists of a material which has a higher degree of hardness than a material which makes up the sealing body 7.

The sealing body 7 has a circular cross section in the region of the sealing section 16, wherein an external radius R of the annulus is approximately double an internal radius r of the annulus.

The sealing body 7 and the main body 8 are partially configured in the cover section 10, wherein an outer surface of the main body 8 forms the top surface 5 and the top surface 5 covers the sealing body 7 in the axial direction Z.

In order to define the insertion depth of the stopper 1 in the axial direction Z and to improve the sealing action of the stopper 1 and to facilitate the removal of the stopper 1 from the container 18, the cover section 10 has a radial dimension which is larger than a radial dimension of the insertion section 2. In the state fully inserted into the container 18 of the stopper 1, therefore, a bearing surface 11 of the cover section 10 remote from the top surface 5 bears against the outer surface 20 of the container 18. In this case, this bearing surface 11 of the cover section 10 is formed by an outer surface of the sealing body 7.

Both the main body 8 and the sealing body 7 of the stopper 1 are radially symmetrical to an axis of symmetry of the stopper 1 extending in the axial direction Z.

The main body 8 is configured both in the region of the insertion section 2 in a substantially circular cylindrical manner and in the region of the cover section 10 in a substantially circular cylindrical manner, wherein the main body 8 has a larger diameter in the region of the cover section 10 than in the region of the insertion section 2.

In the region of the cover section 10 the main body 8 also has a peripheral first projection 12 which is configured in the radial direction X, Y. This first projection 12, for example, may serve for holding the stopper 1 in an additional closure which may be attached to the container 18.

In order to reduce further the effective outer surface of the stopper 1, in the second exemplary embodiment of the stopper 1 shown in FIGS. 8 to 11, the main body 8 partially covers the sealing body 7 radially outwardly in the region of the cover section 10. To this end, in the region of the cover section 10 the main body 8 has a peripheral second projection 13 which is configured radially outwardly and which extends from the top surface 5 in the direction of the bottom surface 4, wherein the second projection 13 at least partially covers the sealing body 7 radially outwardly in the region of the cover section 10.

Figure 8:
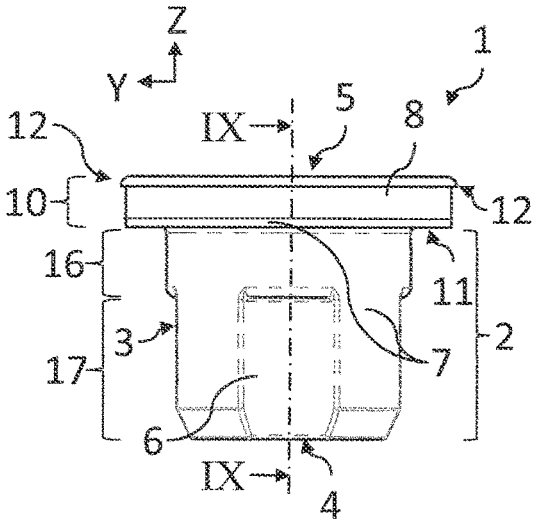
FIG. 8 shows a second embodiment of the stopper in a view according to the arrow VIII in FIG. 9
Figure 9:
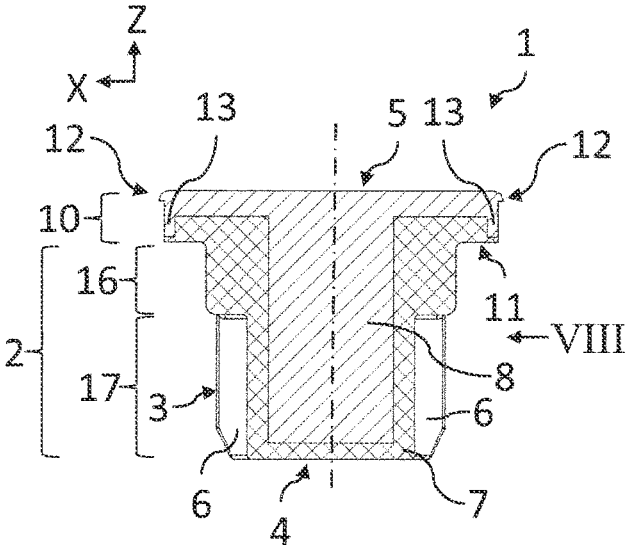
FIG. 9 shows the stopper in a sectional view according to the line IX-IX in FIG. 8.
Figure 10:
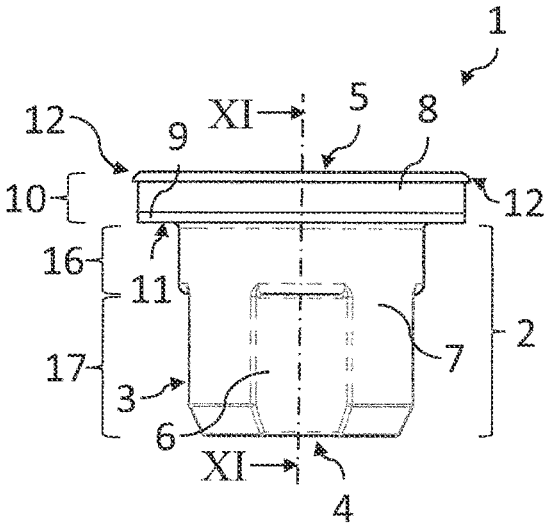
FIG. 10 shows a third embodiment of the stopper in a view according to the arrow X in FIG. 11.
Figure 11:
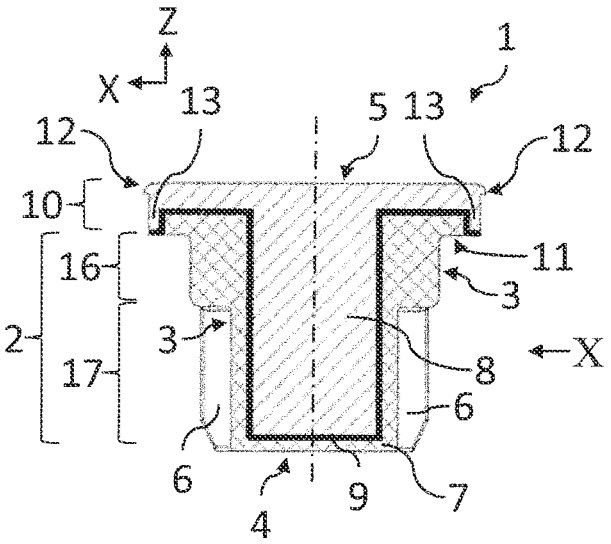
FIG. 11 shows the stopper in a sectional view according to the line XI-XI in FIG. 10.

The third exemplary embodiment of the stopper 1 shown in FIGS. 10 and 11 substantially differs from the exemplary embodiment shown in FIGS. 8 and 9 in that the stopper 1 has a blocking body 9 in the form of a blocking layer 9 which is configured between the main body 8 and the sealing body 7, in order to improve the blocking action of the stopper 1, for example against the diffusion of oxygen. The blocking layer 9 and/or the blocking body 9, for example, may consist of ethylene vinyl alcohol copolymer (EVOH) or aluminum. Preferably the blocking body 9 and/or the blocking layer 9 is connected by a material connection to the main body 8 and/or by a material connection to the sealing body 7. Such a stopper 1 may be produced, for example, by means of a three-component injection-molding method. However, it is also perfectly conceivable that the blocking body 9 and/or the blocking layer 9 is held between the main body 8 and the sealing body 7 in a clamped or positive manner.

Figure 12:
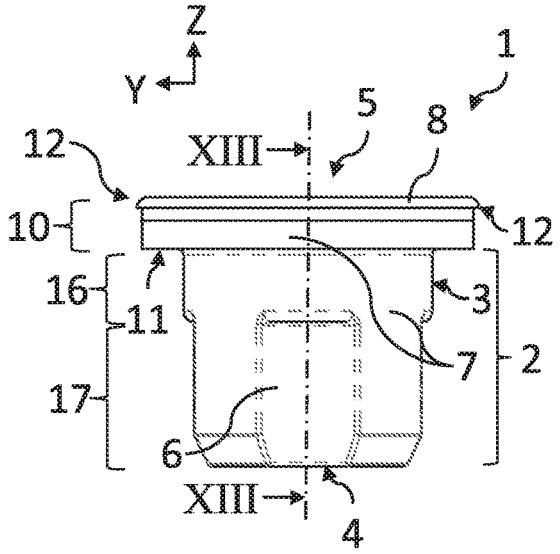
FIG. 12 shows a fourth embodiment of the stopper in a view according to the arrow XII in FIG. 13.
Figure 13:
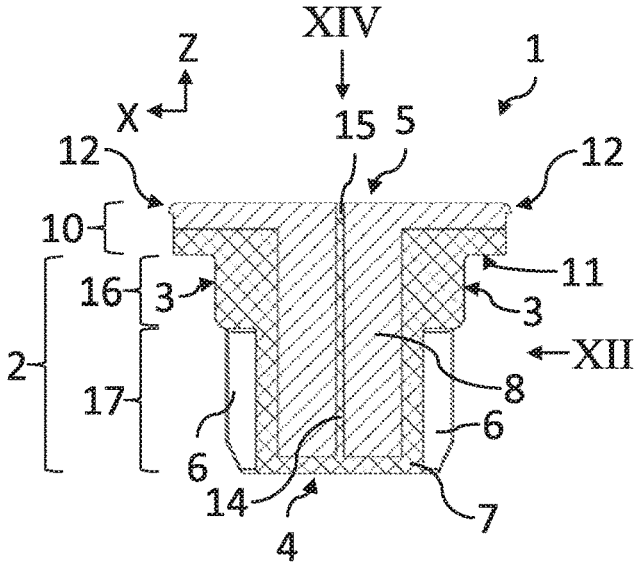
FIG. 13 shows the stopper in a sectional view according to the line XIII-XIII in FIG. 12.
Figure 14:
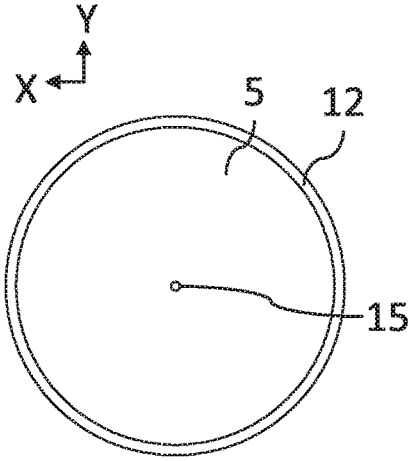
FIG. 14 shows the stopper in a view according to the arrow XIV in FIG. 13.

The fourth exemplary embodiment of the stopper 1 shown in FIGS. 12 to 14 substantially differs from the first exemplary embodiment in that the main body 8 has a central through-channel 15 extending from the top surface 5 in the direction of the bottom surface 4, wherein a partial region 14 of the sealing body 7 extending from the bottom surface 4 in the direction of the top surface 5 is configured in the through-channel 15, whereby the main body 8 radially encloses this partial region 14 of the sealing body 7. The through-channel 15 permits a removal of the container contents without removing the stopper 1 from the container 18 by, for example, a needle being inserted into the through-channel 15 and the sealing body 7 being punctured in the insertion region of the needle.

Moreover, such an embodiment of the stopper 1 is able to be produced in a particularly simple and cost-effective manner, by the main body 8 being initially produced, for example, by an injection-molding method and subsequently thereto the sealing body 7 being injection-molded onto the main body 8, wherein the injection-molding of the sealing body 7 takes place through the through-channel 15 of the main body 8. By the centrally configured through-channel 15 and the resulting central injection-molding of the sealing body 7 on the main body 8, shape tolerances of the stopper 1 are additionally reduced.

Figure 15:
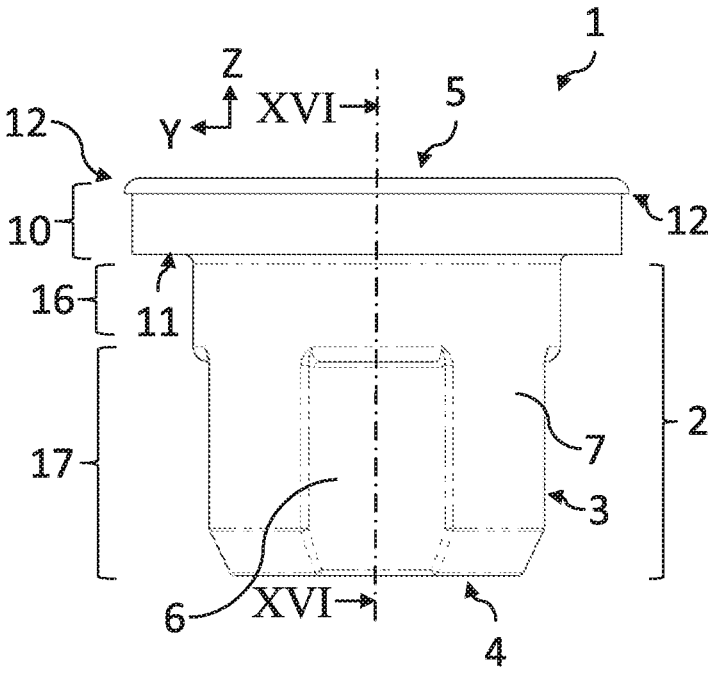
FIG. 15 shows a fifth embodiment of the stopper in a view according to the arrow XV in FIG. 16.
Figure 16:
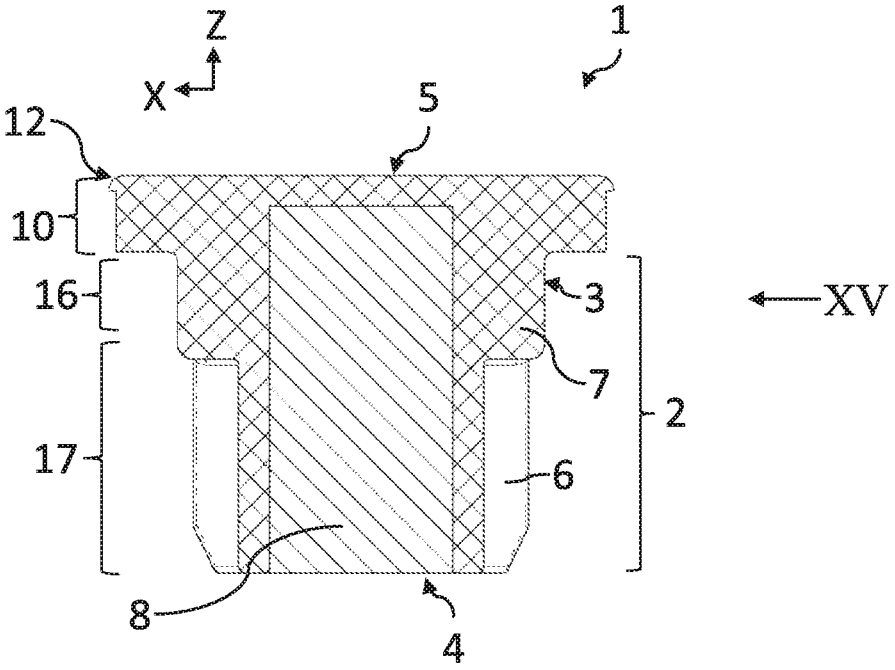
FIG. 16 shows the stopper in a sectional view according to the line XVI-XVI in FIG. 15.

The fifth exemplary embodiment of the stopper 1 shown in FIGS. 15 and 16 substantially differs from the first exemplary embodiment in that the main body 8 has an outer surface, wherein a partial region of this outer surface in the axial direction Z of the stopper 1 is not covered by the sealing body 7. In the present case, this outer surface of the main body 8 forms a partial region of the bottom surface 4, wherein the corresponding outer surface of the sealing body 7, which also forms a partial region of the bottom surface 4, terminates in a planar manner with this outer surface of the main body 8 in the axial direction Z. Moreover, in contrast to the first exemplary embodiment of the stopper 1 the top surface 5 is formed by the sealing body 7.

Figure 17:
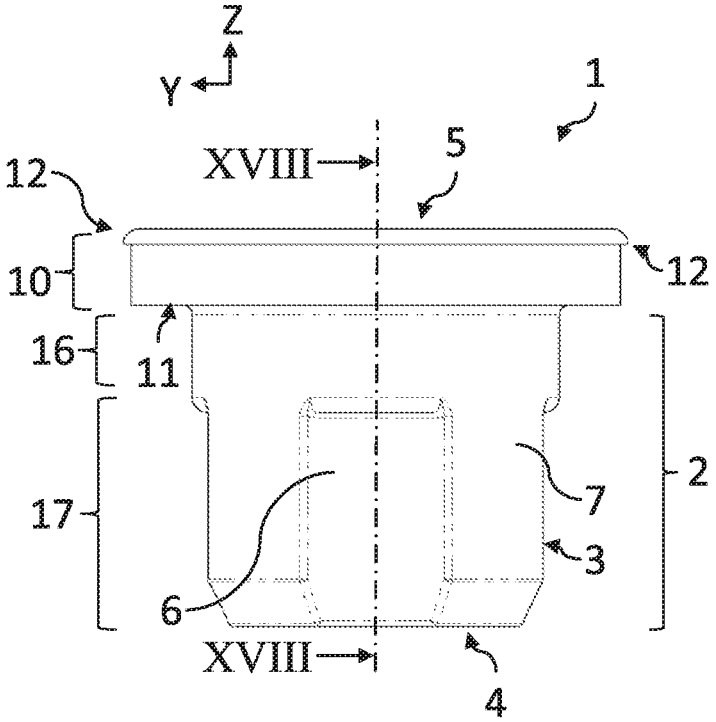
FIG. 17 shows a sixth embodiment of the stopper in a view according to the arrow XVII in FIG. 18.
Figure 18:
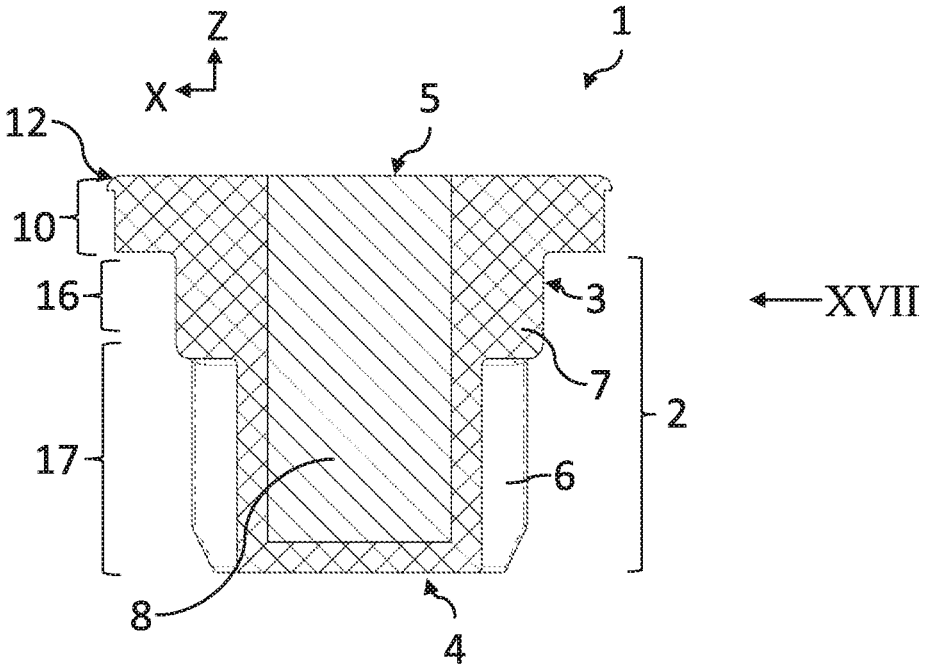
FIG. 18 shows the stopper in a sectional view according to the line XVIII-XVIII in FIG. 17.

The sixth exemplary embodiment of the stopper 1 shown in FIGS. 17 and 18 substantially differs from the first exemplary embodiment in that the main body 8 has an outer surface, wherein a partial region of this outer surface in the axial direction Z of the stopper 1 is not covered by the sealing body 7. In the present case, this outer surface of the main body 8 forms a partial region of the top surface 5, wherein the corresponding outer surface of the sealing body 7, which also forms a partial region of the top surface 5, terminates in a planar manner with this outer surface of the main body 8 in the axial direction Z.

Figure 19:
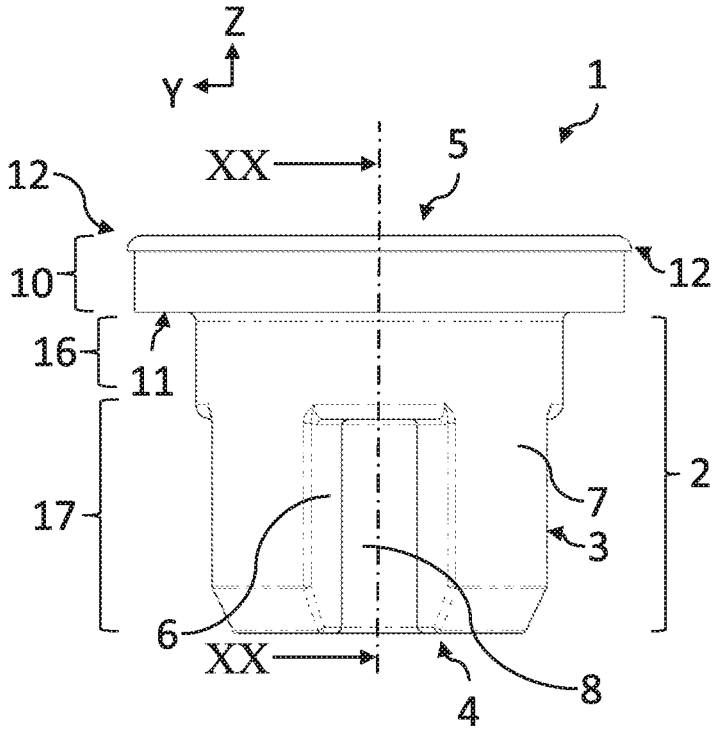
FIG. 19 shows a seventh embodiment of the stopper in a view according to the arrow XIX in FIG. 20.
Figure 20:
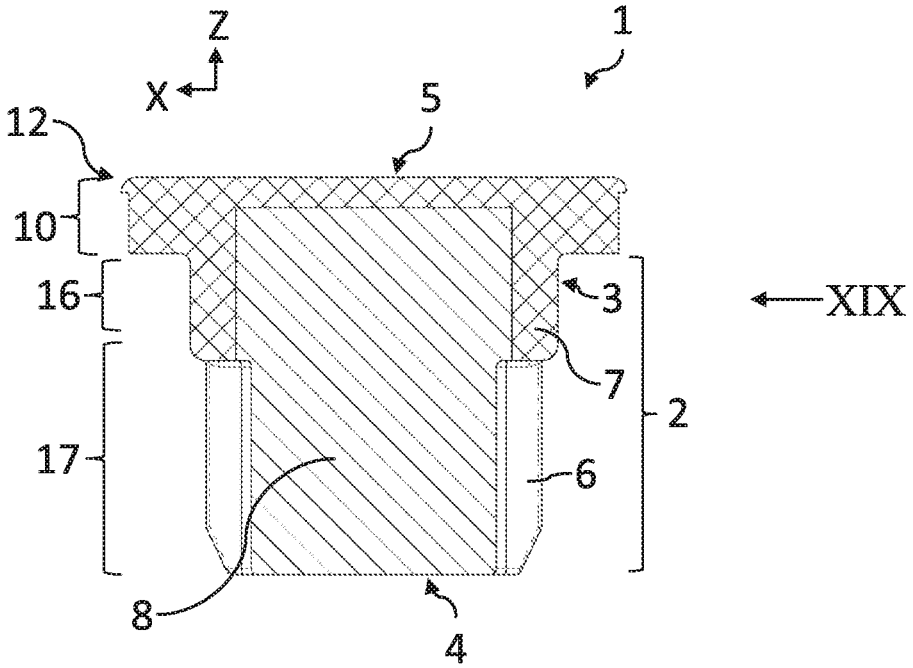
FIG. 20 shows the stopper in a sectional view according to the line XX-XX in FIG. 19.

The seventh exemplary embodiment of the stopper 1 shown in FIGS. 19 and 20 substantially differs from the fifth exemplary embodiment in that the lateral surface 3 of the insertion section 2 is not exclusively formed by the outer surfaces of the sealing body 7 but merely the regions of the lateral surface 3 of the insertion section 2, which are in contact with the inner surface 21 of the container wall 24 in the drying position and/or the sealing position, are formed by the outer surfaces of the sealing body 7. Accordingly, in the region of the insertion section 2 only the outer surfaces of the more flexible sealing body 7 come into contact with inner surfaces 21 of the container wall 24 in the drying position and/or the sealing position. Partial regions of the lateral surface 3 of the insertion section 2, in the present case a partial region of the lateral surface 3 adjoining the respective recess 6, are formed by the outer surfaces of the main body 8.

Figure 21:
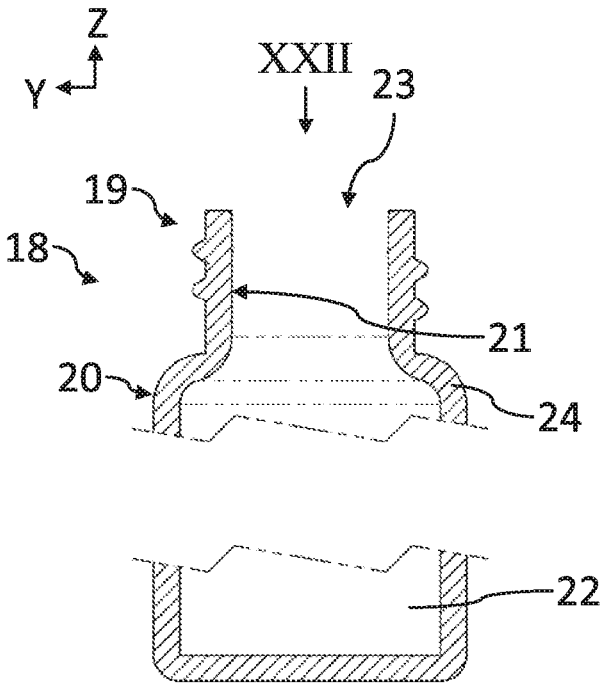
FIG. 21 shows the container according to FIG. 1 in a sectional view according to the line XXI-XXI in FIG. 22.
Figure 22:
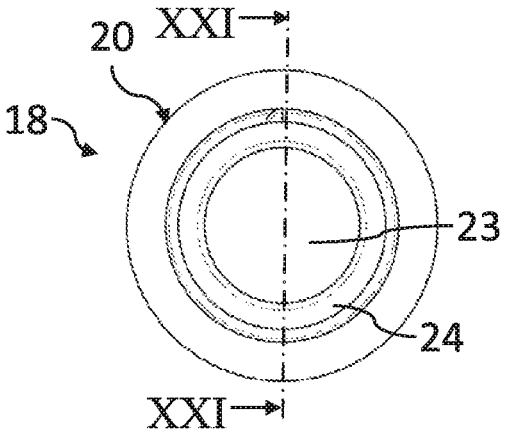
FIG. 22 shows the container in a view according to the arrow XXII in FIG. 21.

FIGS. 21 and 22 show the container 18 without a stopper 1.

In order to facilitate an insertion of the stopper 1, the exemplary embodiments of the stopper 1, which are shown in the drawing figures in a region of the contact section 17 comprising the bottom surface 4, have a conical external contour.

That which is claimed is:

1. A stopper for a container for use in freeze-drying processes, wherein the stopper has an insertion section configured for insertion into the container, and the insertion section has a lateral surface and a bottom surface, wherein the bottom surface of the insertion section is configured opposite a top surface of the stopper in an axial direction of the stopper, and the insertion section has a sealing section for closing the container in a fluid-tight manner in a sealing position of the stopper and a contact section which adjoins the sealing section axially in the direction of the bottom surface of the insertion section for holding the stopper in a drying position of the stopper, wherein the contact section has at least one passage opening for a gas exchange between an interior of the container and the surroundings of the container, wherein the at least one passage opening extends from the lateral surface of the insertion section into the bottom surface of the insertion section and the stopper has a sealing body and a main body connected together, wherein outer surfaces of the sealing body in the region of the sealing section form the lateral surface of the insertion section and the main body is configured within the sealing body in the region of the sealing section, wherein the outer surfaces of the sealing body form the lateral surface of the insertion section and the bottom surface of the insertion section, wherein the bottom surface of the insertion section forms a continuous closed surface that encloses the main body such that the main body is sealed from the interior of the container, wherein the main body consists of a material which has a higher degree of hardness than a material which makes up the sealing body, wherein regions of the lateral surface of the insertion section in contact with an inner surface of a container wall of the container in the drying position and/or the sealing position are formed by the outer surfaces of the sealing body in the region of the contact section, and wherein the main body is configured within the sealing body in the region of the contact section.

2. The stopper as claimed in claim 1, wherein the outer surfaces of the sealing body form the lateral surface of the insertion section in the region of the contact section.

3. The stopper as claimed in claim 1, wherein the main body has an outer surface, wherein at least a partial region of the outer surface of the main body is not covered by the sealing body in the axial direction of the stopper.

4. The stopper as claimed in claim 3, wherein the outer surface of the main body forms at least a partial region of the top surface of the stopper.

5. The stopper as claimed in claim 1, wherein the sealing body and the main body are directly connected together by a material connection.

6. The stopper as claimed in claim 1, wherein an outer surface of the main body forms the top surface of the stopper and the top surface of the stopper covers the sealing body in the axial direction.

7. The stopper as claimed in claim 1, wherein the stopper has a cover section adjoining the insertion section in the axial direction, and wherein a radial dimension of the cover section is larger than a radial dimension of the insertion section.

8. The stopper as claimed in claim 7, wherein an outer surface of the sealing body forms a bearing surface of the cover section remote from the top surface of the stopper.

9. The stopper as claimed in claim 1, wherein the sealing body in the region of the sealing section has a circular cross section perpendicular to the axial direction of the stopper, and wherein a ratio of an external radius of the sealing body and an internal radius of the sealing body is from about 1.1 to about 2.5.

10. The stopper as claimed in claim 1, wherein the insertion section comprises at least one recess, and wherein the recess forms the at least one passage opening.

11. The stopper as claimed in claim 1, wherein the sealing body consists of a material which has a Shore A hardness of about 40 to about 80 according to DIN ISO 7619-1:2010 and/or the sealing body consists of a thermoplastic elastomer (TPE).

12. The stopper as claimed in claim 1, wherein the main body consists of a material which has a Shore D hardness of about 30 to about 100 according to DIN ISO 7619-1:2010 and/or the main body consists of polypropylene (PP) or high density polyethylene (HDPE).

13. The stopper as claimed in claim 1, wherein the contact section is free of regions protruding outwardly relative to the sealing section in a radial direction.

14. An assembly of a container and a stopper for use during freeze-drying processes, wherein the stopper is inserted into an opening of the container, the stopper has an insertion section configured to be inserted into the container, and the insertion section has a lateral surface and a bottom surface, wherein the bottom surface is configured opposite a top surface of the stopper in an axial direction of the stopper, and the insertion section has a sealing section for closing the container in a fluid-tight manner from the surroundings of the container in a sealing position of the stopper and a contact section which adjoins the sealing section axially in the direction of the bottom surface of the insertion section for holding the stopper in a drying position of the stopper during the freeze-drying processes, wherein the contact section has at least one passage opening for a gas exchange between an interior of the container and the surroundings of the container during the freeze-drying processes, wherein the at least one passage opening extends from the lateral surface of the insertion section into the bottom surface of the insertion section, and the stopper has a sealing body and a main body which are connected together, wherein outer surfaces of the sealing body in the region of the sealing section form the lateral surface of the insertion section and the main body is configured within the sealing body in the region of the sealing section, wherein the outer surfaces of the sealing body form the lateral surface of the insertion section and the bottom surface of the insertion section, wherein the bottom surface of the insertion section forms a continuous closed surface that encloses the main body such that the main body is sealed from the interior of the container, wherein the main body consists of a material which has a higher degree of hardness than a material which makes up the sealing body, wherein in the drying position of the stopper the sealing section is arranged outside the container, the contact section is in contact with an inner surface of a container wall of the container and the at least one passage opening opens into the interior of the container and into the surroundings, and wherein in the sealing position of the stopper the sealing section is arranged within the container and the sealing section is in contact in a peripheral manner with the inner surface of the container wall of the container, wherein regions of the lateral surface of the insertion section, which are in contact with the inner surface of the container wall of the container in the drying position and/or the sealing position, are formed by the outer surfaces of the sealing body in the region of the contact section, and wherein the main body is configured within the sealing body in the region of the contact section.

* * * * *